US008453752B2

(12) United States Patent
Katsuraku

(10) Patent No.: US 8,453,752 B2
(45) Date of Patent: Jun. 4, 2013

(54) METHOD OF MANUFACTURING FIRE-EXTINGUISHING AGENT AND THROW-TYPE FIRE EXTINGUISHER

(75) Inventor: Yoshiyuki Katsuraku, Saitama (JP)

(73) Assignee: Japan Fire Protect Co., Ltd., Saitama (JP)

( * ) Notice: Subject to any disclaimer, the term of this patent is extended or adjusted under 35 U.S.C. 154(b) by 174 days.

(21) Appl. No.: 12/913,286

(22) Filed: Oct. 27, 2010

(65) Prior Publication Data

US 2011/0308821 A1 Dec. 22, 2011

Related U.S. Application Data

(63) Continuation-in-part of application No. PCT/JP2010/060171, filed on Jun. 16, 2010.

(51) Int. Cl.
*A62C 8/00* (2006.01)

(52) U.S. Cl.
USPC ..... 169/36; 169/11; 169/27

(58) Field of Classification Search
CPC ..... A62C 8/00; A62C 35/00; A62C 35/02
USPC ..... 169/5, 11, 27, 28, 36
See application file for complete search history.

(56) References Cited

U.S. PATENT DOCUMENTS

| | | | | |
|---|---|---|---|---|
| 6,796,382 | B2 * | 9/2004 | Kaimart | 169/36 |
| 7,143,833 | B2 * | 12/2006 | Gaidano et al. | 169/27 |

FOREIGN PATENT DOCUMENTS

| | | |
|---|---|---|
| JP | B2-3081531 | 8/2000 |
| JP | A-2001-37901 | 2/2001 |
| JP | 2005-288059 | 10/2005 |
| JP | A-2007-20965 | 2/2007 |
| JP | A-2007-20966 | 2/2007 |
| JP | A-2008-51442 | 3/2008 |
| JP | B2-4437053 | 3/2010 |
| JP | A-2010-119754 | 6/2010 |

OTHER PUBLICATIONS

International Search Report mailed Oct. 12, 2010 issued in International Patent Application No. PCT/JP2010/060171 (with translation).

International Preliminary Report on Patentability dated Jan. 17, 2013 from International Application No. PCT/JP2010/060171.

* cited by examiner

*Primary Examiner* — Steven J Ganey
(74) *Attorney, Agent, or Firm* — Oliff & Berridge, PLC

(57) ABSTRACT

A method of manufacturing a fire-extinguishing agent for a fire extinguisher and a fire extinguishing apparatus is provided. The fire-extinguishing agent is manufactured by dissolving 55 g to 65 g of diammonium hydrogen phosphate in 300 to 350 mL of hot water at 70° C. to 90° C. to prepare a solution, dissolving 6 g to 8 g of ammonium sulfate in the prepared solution, dissolving 170 g to 190 g of potassium carbonate in the resultant solution, and adding, to the resultant solution, 25 to 35 mL of the undiluted solution of an aqueous film-forming foam fire-extinguishing agent. The total amount of the fire-extinguishing agent is adjusted to 600 mL. A throw-type fire extinguisher having a total weight of 700 g to 800 g is produced by charging a container with 600 mL of the fire-extinguishing agent.

1 Claim, 3 Drawing Sheets

METHOD OF MANUFACTURING FIRE-EXTINGUISHING AGENT AND THROW-TYPE FIRE EXTINGUISHER

This is a Continuation-in-Part of Application No. PCT/JP2010/060171 filed Jun. 16, 2010. The disclosure of the prior application is hereby incorporated by reference herein in its entirety.

BACKGROUND OF THE INVENTION

1. Field of the Invention

The present invention relates to a method of manufacturing a fire-extinguishing agent suitably used for a throw-type fire extinguisher and to a throw-type fire extinguisher that uses the fire-extinguishing agent manufactured by this manufacturing method.

2. Description of the Related Art

Fire-extinguishing agents are composed of various compositions. For example, in Japanese Patent Application Laid-Open No. 2001-37901, urea, sodium chloride, anhydrous sodium carbonate, ammonium sulfate, and other components are used.

Although the various compositions included in the fire-extinguishing agents are disclosed, the know-how to manufacture these agents is generally not disclosed.

Japanese Patent No. 4437053 discloses a fire-extinguishing agent prepared as a solution of sodium chloride, diammonium hydrogen phosphate, and ammonium bicarbonate.

Japanese Patent No. 3081531, for example, discloses a throw-type fire extinguisher in which an impact-breakable container having a shape and weight suitable for throwing is charged with a fire-extinguishing agent in an amount suitable for initial fire extinguishing.

The heat of a fire causes the fire-extinguishing agent to emit carbon dioxide gas and ammonia gas for extinguishing the fire. However, a high-temperature environment such as the environment of a kitchen can also cause carbon dioxide gas and ammonia gas to be generated, and this can result in an increase in the internal pressure of the resin container or the fire extinguisher. Therefore, the resin container and other parts must have strength enough to resist the increased internal pressure.

In case of fire, the throw-type fire extinguisher is thrown into the source of the fire to break the container so that the fire-extinguishing agent is dispersed. However, if the strength of the container is increased to resist the increase in internal pressure at high temperature, there is the problem in that the container is less likely to break when thrown into the source of a fire and much less likely to break if the source of the fire is a soft material such as a sofa or clothes.

The throw-type fire extinguisher must be thrown from a position close to the source of a fire. However, if it is dangerous to approach the flames, the fire extinguisher must be thrown from a position away from the source of the fire. A conventional throw-type fire extinguisher has a weight of approximately 1 kg. Therefore, when a person with normal physical strength throws such a throw-type fire extinguisher from a position away from the source of a fire, it may not reach the source of the fire, and a sufficient fire extinguishing effect may not be obtained.

SUMMARY OF THE INVENTION

In view of the foregoing problems, various exemplary embodiments of this invention provide a method of manufacturing a fire-extinguishing agent that does not generate carbon dioxide gas and ammonia gas in a high-temperature environment during non-use.

Various exemplary embodiments of this invention also provide a throw-type fire extinguisher that uses the above fire-extinguishing agent. This fire extinguisher includes a container that can reliably break at the time of extinguishing a fire so that the fire-extinguishing agent is dispersed.

The present invention achieves the former object by providing a method of manufacturing a fire-extinguishing agent used in a fire extinguisher or a fire extinguishing apparatus, the method including the steps of: dissolving 55 to 65 g diammonium hydrogen phosphate in 300 to 350 mL of hot water at 70° C. to 90° C. to prepare a solution; dissolving 6 to 8 g of ammonium sulfate in the solution; dissolving 170 to 190 g of potassium carbonate in the solution; and adding, to the solution, 25 to 35 mL of an undiluted solution of an aqueous film-forming foam fire-extinguishing agent, wherein a total amount of the fire-extinguishing agent is adjusted to 600 mL.

The latter object is achieved by a throw-type fire extinguisher including the fire-extinguishing agent manufactured by the above manufacturing method and a sealed container charged with the fire-extinguishing agent, wherein the throw-type fire extinguisher has a total weight of 700 g to 800 g.

DETAILED DESCRIPTION OF THE PREFERRED EMBODIMENTS

Figure 1:
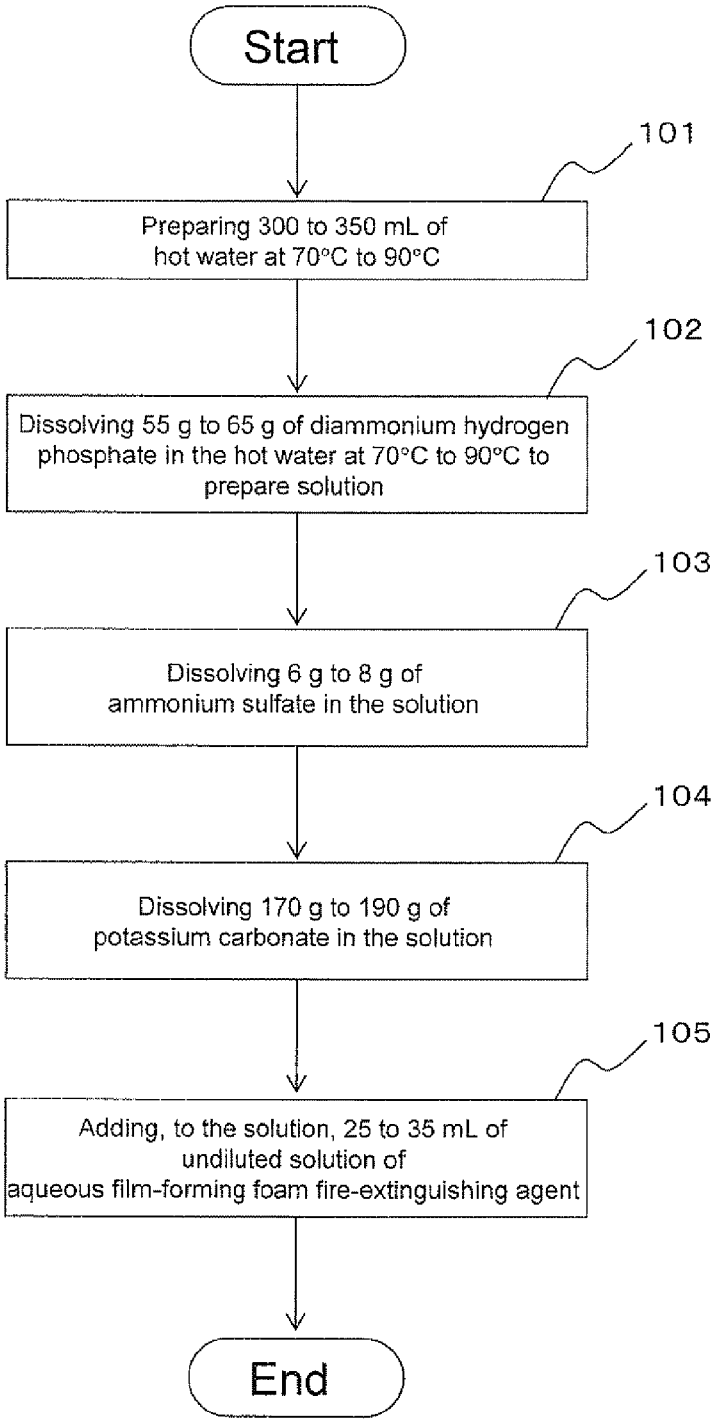
FIG. 1 is a flowchart showing an exemplary embodiment of a manufacturing method of the present invention.

A method of manufacturing a fire-extinguishing agent in an exemplary embodiment of the present invention will be described with reference to a flowchart in FIG. 1.

In this exemplary embodiment, the total amount of the fire-extinguishing agent is adjusted to 600 mL.

First, in step 101, 300 to 350 mL of hot water at 70° C. to 90° C. is prepared.

Next, in step 102, 55 to 65 g of diammonium hydrogen phosphate is dissolved in the hot water to prepare a solution.

In step 103, 6 to 8 g of ammonium sulfate is dissolved in the prepared solution.

In step 104, 170 to 190 g of potassium carbonate is dissolved in the resultant solution, and the preparation of the fire-extinguishing agent is completed.

In step 105, 25 to 35 mL of the undiluted solution (used as, for example, a 3% dilution) of an aqueous film-forming foam fire-extinguishing agent is dissolved in the fire-extinguishing agent.

The aqueous film-forming foam fire-extinguishing agent includes a known surfactant for the formation of aqueous film-forming foam. More specifically, an aqueous film-forming foam fire-extinguishing agent containing, as a minor component, a fluorine-based surfactant having high heat resistance is preferred. Examples include "Alpha Foam (Product name)" (product of YAMATO PROTEC CORPORATION).

The diammonium hydrogen phosphate, ammonium sulfate, and potassium carbonate react with the heat of a fire to be extinguished and are decomposed into carbon dioxide gas and ammonia gas.

The carbon dioxide gas inhibits the supply of oxygen in air to the surface of a burning object. The ammonia gas has a cooling effect that allows the surface temperature of the burning object to be reduced and is alkaline, so that the oxidized burning object is neutralized to extinguish the fire.

The ammonium sulfate has a property of increasing the ignition point of wood and other materials and can prevent re-ignition after the fire is extinguished.

In the above exemplary embodiment, diammonium hydrogen phosphate, ammonium sulfate, and potassium carbonate are dissolved in hot water at 70° C. to 90° C. Therefore, they are partially decomposed into carbon dioxide gas and ammonia gas by the heat of the hot water and then emitted.

This fire-extinguishing agent does not generate carbon dioxide gas and ammonia gas even when exposed to an atmosphere at 70° C. to 90° C. in houses, factories, restaurants, and other places. Therefore, if a resin container that easily breaks upon impact is charged with the fire-extinguishing agent, an increase in inner pressure due to ambient temperature is suppressed. Accordingly, the container can have low resistance to pressure and can thereby be reduced in weight.

When the temperature of the fire-extinguishing agent at the time of extinguishing a fire exceeds 90° C. because of the heat of the fire, components that have not been decomposed into carbon dioxide gas and ammonia gas by the heat of the hot water at 70° C. to 90° C. are decomposed, and the above fire distinguishing effect can thereby be obtained.

In the above exemplary embodiment, "hot water at 70° C. to 90° C." is used in consideration of the maximum ambient temperature when a fire extinguisher or a fire extinguishing apparatus charged with the fire-extinguishing agent in this exemplary embodiment is placed in, for example, a commercial kitchen.

The reason that the total amount of the fire-extinguishing agent is adjusted to 600 mL is as follows. When an impact-breakable resin container is charged with the fire-extinguishing agent in an amount of 600 mL, the total weight including the weight of the container can be 700 g to 800 g. This weight allows the container to be thrown a long distance, and therefore the container can be thrown from a safe position away from flames.

An impact-breakable resin container was charged with 600 mL of the fire-extinguishing agent manufactured by the manufacturing method in the above exemplary embodiment, and a fire extinguishing experiment was performed using a wood fire extinguishing experiment model prescribed by the fire service law. A fire on this fire extinguishing experiment model was extinguished with 24 L of water. However, it was possible to completely extinguish the fire by throwing three resin containers into the fire. Therefore, it was found that the fire-extinguishing agent in this exemplary embodiment had a fire extinguishing effect about 13 times stronger than that of water.

Impact-breakable resin containers were charged with the fire-extinguishing agent manufactured by the manufacturing method in the above exemplary embodiment. 1,000 mL of gasoline was placed in an oil pan of 300 mm×600 mm (length and width) and then ignited. One minute after, two resin containers were thrown into the oil pan, and the fire was completely extinguished.

Next, an exemplary embodiment of a throw-type fire extinguisher that uses the fire-extinguishing agent manufactured by the above manufacturing method will be described with reference to FIGS. 2 and 3.

Figure 2:
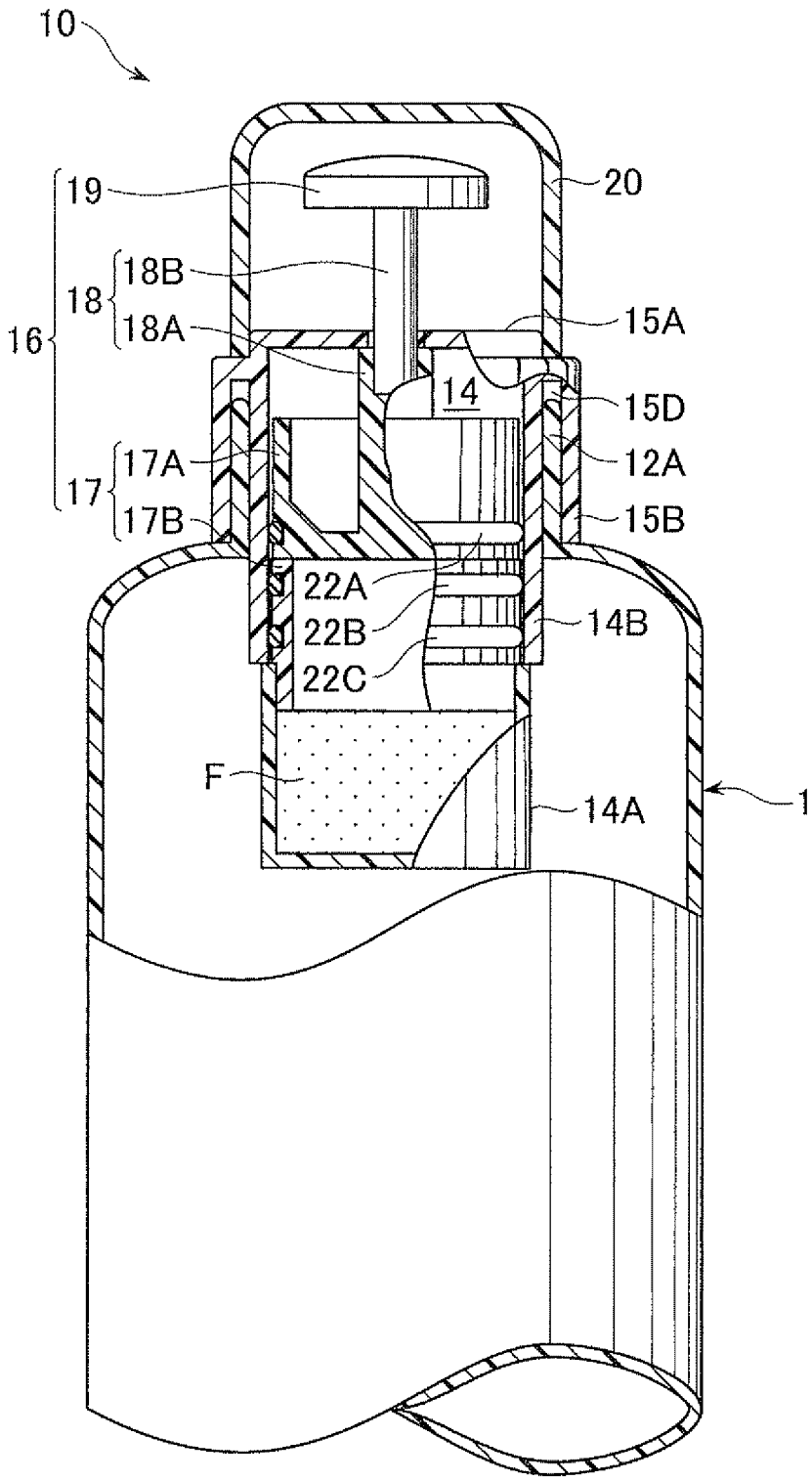
FIG. 2 is a cross sectional view illustrating an exemplary embodiment of a throw-type fire extinguisher of the present invention.

As shown in FIG. 2, this throw-type fire extinguisher 10 includes: a sealed container 12 charged with 600 mL of the fire-extinguishing agent manufactured by the above manufacturing method; a foaming agent chamber 14 attached to the upper opening of the container 12 and containing a foaming agent F; and a foaming agent releasing member 16. The foaming agent releasing member 16 is used to drop a foaming agent case 14A constituting the lower section of the foaming agent chamber 14 into the container 12 so that the foaming agent F in the foaming agent case 14A comes into contact with the fire-extinguishing agent to foam the fire-extinguishing agent.

For further details, the foaming agent chamber 14 includes: a lid portion 15A disposed at its upper end; a cylindrical fitting member 14B having an open lower end; and the foaming agent case 14A having an upper end that is in contact from below with the opening lower end of the fitting member 14B so as to close the opening lower end. The fitting member 14B is attached to the upper opening end of the container 12, and the opening lower end of the fitting member 14B extends inside the container 12. The foaming agent case 14A has a closed end cylindrical shape with an open upper end.

The throw-type fire extinguisher 10 has a weight of 700 g to 800 g, including the weights of the fire-extinguishing agent, the foaming agent F, and the container. The foaming agent chamber 14 has a cylindrical shape, and the foaming agent releasing member 16 is disposed so as to be slidable inside the foaming agent chamber 14 in the direction of an axial line.

More specifically, the foaming agent releasing member 16 includes a piston-shaped pushing member 17 and a shaft member 18 disposed integrally with the pushing member 17 so as to extend along the center line passing through the center of the pushing member 17 and extending upward. The pushing member 17 includes: an integrated piston 17A integrated with an end portion 18A of the shaft member 18 as described above; and a separable piston 17B having open opposite ends and disposed in contact with the lower end (in FIG. 2) of the integrated piston 17A in a separable manner.

The shaft member 18 includes the end portion 18A in the lower half and a base portion 18B in the upper half, and the end portion 18A extends downward in FIG. 2 and is formed integrally with the integrated piston 17A of the pushing member 17.

The base portion 18B of the shaft member 18 that is on the side opposite to the end portion 18A protrudes upward through the center of the lid portion 15A on the fitting member 14B. A push button-like pressing member 19 is provided at the upper end of the base portion 18B.

The protruding portion (the base portion 18B) of the shaft member 18 that protrudes from the lid portion 15A and the pressing member 19 are capped with a cap 20 fitted on the outer circumference of the lid portion 15A.

An O-ring 22A is disposed on the outer circumference of the integrated piston 17A, and O-rings 22B and 22C are disposed on the outer circumference of the separable piston 17B. These O-rings come in contact with the inner circumference of the fitting member 14B to form seals.

The upper inner circumference of the foaming agent case 14A is hermetically fitted from below on the lower outer circumference of the separable piston 17B. The upper end of the foaming agent case 14A that is fitted on the lower outer circumference of the separable piston 17B abuts against the lower end of the fitting member 14B. The outer diameter of the foaming agent case 14A is larger than the inner diameter of the fitting member 14B, and the inner diameter of the foaming agent case 14A is smaller than the outer diameter of the separable piston 17B.

A fitting outer cylindrical portion 15B coaxial and parallel with the outer circumference of the fitting member 14B is disposed along the upper half portion thereof, and an annular fitting groove 15D is formed between the fitting outer cylindrical portion 15B and the outer circumference of the fitting member 14B.

The fitting member 14B is inserted into the container 12 from its upper end and secured thereto such that a cylindrical socket 12A forming the upper opening of the container 12 is fitted into the annular fitting groove 15D.

In a usual state, the pressing member 19 is spaced upward from the upper lid portion 15A as shown in FIG. 2. When the throw-type fire extinguisher 10 is used in case of fire, the operator removes the cap 20 and pushes the uncovered pressing member 19 with a finger.

Figure 3:
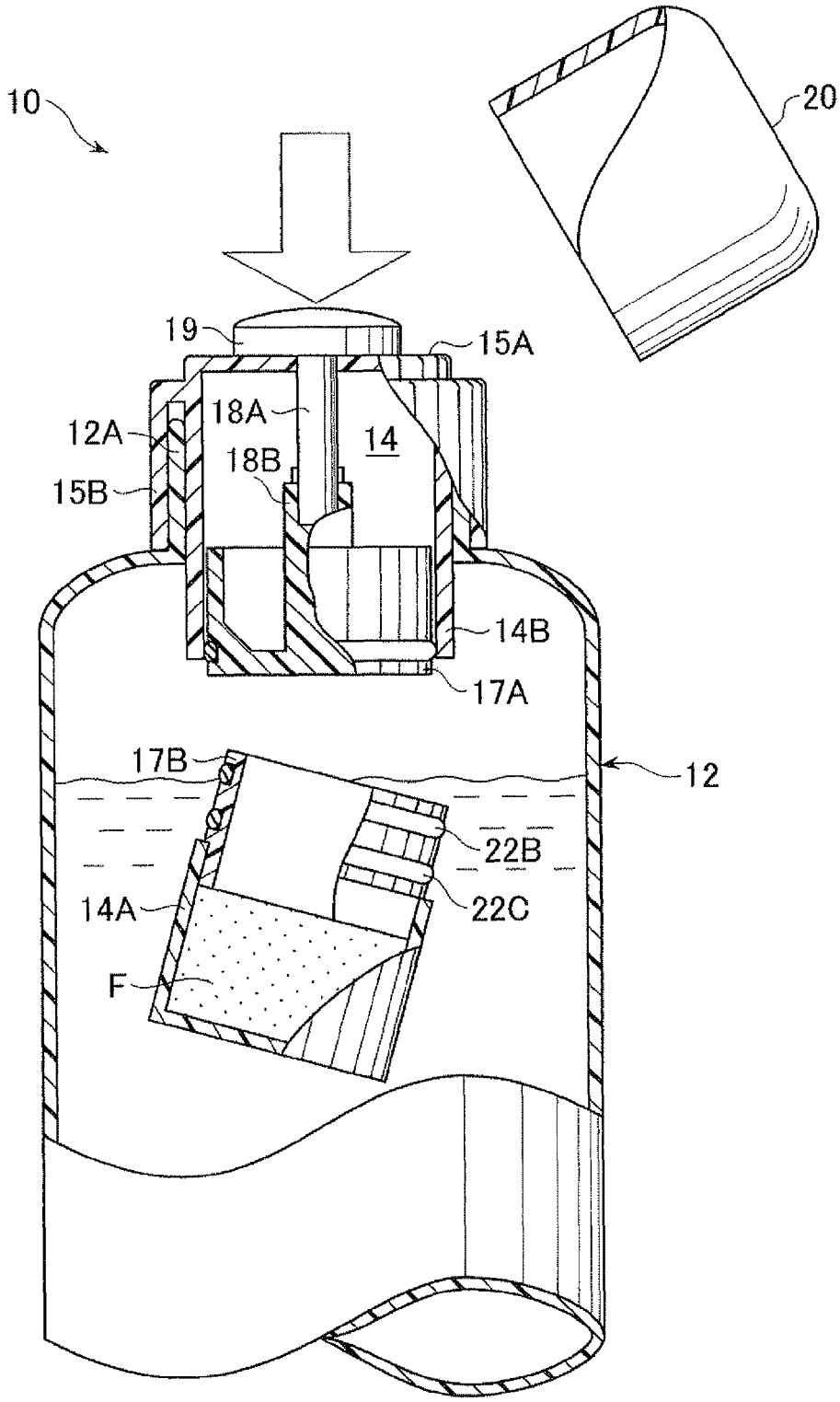
FIG. 3 is a cross sectional view illustrating the throw-type fire extinguisher in the exemplary embodiment upon use.

Then, as shown in FIG. 3, the entire foaming agent releasing member 16 is pushed down toward the center of the container 12 until the pressing member 19 abuts against the lid portion 15A. The foaming agent case 14A is thereby pushed down together with the separable piston 17B, separated from the lower end of the fitting member 14B, and drops into the fire-extinguishing agent in the container 12.

Since the separable piston 17B has a cylindrical shape with open opposite ends, the foaming agent F is spilled into the fire-extinguishing agent, or the fire-extinguishing agent enters the foaming agent case 14A, so that the foaming agent F comes into contact with the fire-extinguishing agent. The fire-extinguishing agent is thereby foamed in the container 12, and the inner pressure increases. When the throw-type fire extinguisher 10 in this state is thrown into the source of a fire, the container 12 breaks on impact, and the fire-extinguishing agent is dispersed to extinguish the fire. If the container 12 does not break on impact, it is self-destructed.

In the throw-type fire extinguisher 10, its components other than the fire-extinguishing agent and the foaming agent are made of polyvinyl chloride (PVC), and the total weight is 700 to 800 g, which is lighter than the weight of a conventional product (1 kg). Therefore, the throw-type fire extinguisher 10 can reach the source of a fire even when it is thrown from a position further away from the source of the fire than the position for the conventional product.

In a usual state, the throw-type fire extinguisher 10 is capped with the cap 20 so that the foaming agent releasing member 16 is not operated, but the present invention is not limited thereto. For example, a pin (not shown) passing through the shaft member 18 of the foaming agent releasing member 16 may be provided. The pin is pulled out at the time of extinguishing a fire so that the foaming agent releasing member 16 releases the foaming agent F in the foaming agent chamber 14.

In the throw-type fire extinguisher 10 in this exemplary embodiment, the fire-extinguishing agent is manufactured using hot water at 70° C. to 90° C., so that carbon dioxide gas and ammonia gas are generated only in an atmosphere at higher than 90° C. (e.g., in flames). Therefore, even when the throw-type fire extinguisher 10 thrown into a fire does not break because the inner pressure is not high and the impact thereon is small, the container 12 is self-destructed, and the fire can be reliably extinguished.

Even when the source of a fire is soft clothes, the container 12 is self-destructed, and therefore the fire-extinguishing agent can be dispersed. As described above, the fire-extinguishing agent in this exemplary embodiment is composed of diammonium hydrogen phosphate, ammonium sulfate, and potassium carbonate. These are harmless to the human body during fire extinguishing, and the components of the residues after the fire is extinguished are the same as the components of fertilizers. Therefore, to dispose of the residues, they may be simply sprinkled on gardens, farms, etc. Since the aqueous film-forming foam fire-extinguishing agent is used, the fire-extinguishing agent can be used for an oil fire.

The fire-extinguishing agent manufactured by the method according to the present invention is used for a fire extinguishing apparatus and for a throw-type fire extinguisher that is produced by charging a breakable container such as a resin container with the fire-extinguishing agent and is thrown into the source of a fire to extinguish the fire.

Description Of Reference Numerals

10 . . . throw-type fire extinguisher
12 . . . container
12A . . . socket
14 . . . foaming agent chamber
14A . . . foaming agent case, 14B . . . fitting member
15A . . . upper end lid portion
15B . . . fitting outer cylindrical portion
15D . . . annular fitting groove
16 . . . foaming agent releasing member
17 . . . pushing member
17A . . . integrated piston
17B . . . separable piston
18 . . . shaft member
18A . . . end portion
18B . . . base portion
19 . . . pressing member
20 . . . cap
F . . . foaming agent

What is claimed is:

1. A throw-type fire extinguisher comprising:

a sealed container charged with a fire-extinguishing agent;

a foaming agent chamber that protrudes downward into the container, the foaming agent chamber including a foaming agent case that forms a lower portion thereof and contains a foaming agent; and a foaming agent releasing member that is used to separate the foaming agent case from the lower portion of the foaming agent chamber so that the foaming agent in the foaming agent case comes into contact with the fire-extinguishing agent in the container to generate foam, wherein the throw-type fire extinguisher has a total weight of 700 g to 800 g, the container is self-destructed when the foam is generated in the container, and the fire-extinguishing agent is manufactured by a method comprising the steps of:

dissolving 55 to 65 g diammonium hydrogen phosphate in 300 to 350 mL of hot water at 70° C. to 90° C. to prepare a solution;

dissolving 6 to 8 g of ammonium sulfate in the solution;

dissolving 170 to 190 g of potassium carbonate in the solution; and adding, to the solution, 25 to 35 mL of an undiluted solution of an aqueous film-forming foam fire-extinguishing agent, wherein a total amount of the fire-extinguishing agent is adjusted to 600 mL.

* * * * *